US005397966A

United States Patent [19]

Vrionis et al.

[11] Patent Number: 5,397,966

[45] Date of Patent: Mar. 14, 1995

[54] RADIO FREQUENCY INTERFERENCE REDUCTION ARRANGEMENTS FOR ELECTRODELESS DISCHARGE LAMPS

[75] Inventors: Nickolas G. Vrionis, Los Altos; Roger Siao, Mountain View, both of Calif.

[73] Assignee: Diablo Research Corporation, Sunnyvale, Calif.

[21] Appl. No.: 883,850

[22] Filed: May 20, 1992

[51] Int. Cl.[6] ..... H05B 41/16

[52] U.S. Cl. ..... 315/248

[58] Field of Search ..... 315/248, 249, 49, 58

[56] References Cited

U.S. PATENT DOCUMENTS

| | | | |
|---|---|---|---|
| 3,227,923 | 1/1966 | Marrison | 315/248 |
| 3,500,118 | 3/1970 | Anderson | 315/57 |
| 3,521,120 | 7/1970 | Anderson | 315/57 |
| 3,987,334 | 10/1976 | Anderson | 315/57 |
| 3,987,335 | 10/1976 | Anderson | 315/62 |
| 4,010,400 | 3/1977 | Hollister | 315/248 |
| 4,017,764 | 4/1977 | Anderson | 315/248 |
| 4,024,431 | 5/1977 | Young | 315/248 |
| 4,048,541 | 9/1977 | Adams et al. | 315/248 |
| 4,070,603 | 1/1978 | Regan et al. | 315/248 |
| 4,117,378 | 9/1978 | Glascock, Jr. | 315/248 |
| 4,119,889 | 10/1978 | Hollister | 315/248 |
| 4,166,234 | 8/1979 | Tak et al. | 313/486 |
| 4,171,503 | 10/1979 | Kwon | 315/248 |
| 4,178,534 | 12/1979 | McNeill et al. | 315/39 |
| 4,206,387 | 6/1980 | Kramer et al. | 315/248 |
| 4,240,010 | 12/1980 | Buhrer | 315/248 |
| 4,245,178 | 1/1981 | Justice | 315/248 |
| 4,245,179 | 1/1981 | Buhrer | 315/248 |
| 4,253,047 | 2/1981 | Walker et al. | 315/248 |
| 4,254,363 | 3/1981 | Walsh | 315/248 |
| 4,260,931 | 4/1981 | Wesselink et al. | 313/493 |
| 4,266,166 | 5/1981 | Proud et al. | 315/248 |
| 4,266,167 | 5/1981 | Proud et al. | 315/248 |
| 4,376,912 | 3/1983 | Jernakoff | 315/248 |
| 4,383,203 | 5/1983 | Stanley | 315/248 |
| 4,390,813 | 6/1983 | Stanley | 315/248 |
| 4,422,017 | 12/1983 | Denneman et al. | 315/248 |
| 4,427,921 | 1/1984 | Proud et al. | 315/248 |
| 4,427,923 | 1/1984 | Proud et al. | 315/248 |
| 4,480,213 | 10/1984 | Lapatovich et al. | 315/248 |
| 4,536,675 | 8/1985 | Postma | 313/46 |

(List continued on next page.)

FOREIGN PATENT DOCUMENTS

| | | | |
|---|---|---|---|
| 98457 | 7/1980 | Japan | 315/248 |

OTHER PUBLICATIONS

Brochure of The operating principles of the Philips QL lamp system, "QL Induction Lighting", Philips Lighting B.V., 1991.

"Electric energy from high-temperature plasmas", John F. Waymouth, Journal I.E.E., Aug. 1962, pp. 380-383.

Brochure, "Macro-Grid Precision-Expanded Foils", Delker Corporation (4 pages).

*Primary Examiner*—Raymond A. Nelli

*Attorney, Agent, or Firm*—Skjerven, Morrill, MacPherson, Franklin & Friel

[57] ABSTRACT

A cost-efficient electrically conductive screen and shield for substantially shielding radio frequency electromagnetic radiation emitted beyond the discharge vessel and the electronic circuitry of an electrodeless discharge lamp is disclosed. The conductive screen and/or shield is disposed outside the space occupied by the gaseous mixture and is grounded to the power supply. This shielding reduces the emission of electromagnetic radiation and, in particular, enables the discharge lamp to comply with FCC standards imposed with respect to the maximum admissible level of interference with wireless communication equipment such as radios and televisions.

31 Claims, 8 Drawing Sheets

U.S. PATENT DOCUMENTS

| | | | |
|---|---|---|---|
| 4,568,859 | 2/1986 | Houkes et al. | 315/248 |
| 4,622,495 | 11/1986 | Smeelen | 315/248 |
| 4,625,152 | 11/1986 | Nakai | 315/317 |
| 4,645,967 | 2/1987 | Bouman et al. | 315/248 |
| 4,661,746 | 4/1987 | Postma et al. | 315/248 |
| 4,675,577 | 6/1987 | Hanlet | 315/248 |
| 4,704,562 | 11/1987 | Postma et al. | 315/248 |
| 4,710,678 | 12/1987 | Houkes et al. | 315/39 |
| 4,727,294 | 2/1988 | Houkes et al. | 315/248 |
| 4,727,295 | 2/1988 | Postma et al. | 315/248 |
| 4,728,867 | 3/1988 | Postma et al. | 315/248 |
| 4,792,727 | 12/1988 | Godyak | 315/176 |
| 4,797,595 | 1/1989 | De Jong | 313/493 |
| 4,812,702 | 3/1989 | Anderson | 313/153 |
| 4,864,194 | 5/1989 | Kobayashi et al. | 315/248 |
| 4,894,590 | 1/1990 | Witting | 315/248 |
| 4,922,157 | 5/1990 | Van Engen et al. | 315/248 |
| 4,927,217 | 5/1990 | Kroes et al. | 315/248 |
| 4,940,923 | 7/1990 | Kroontje et al. | 315/248 |
| 4,952,844 | 8/1990 | Godyak et al. | 315/205 |
| 4,962,334 | 10/1990 | Godyak | 313/619 |
| 4,977,354 | 12/1990 | Bergervoet et al. | 315/248 |
| 4,987,342 | 1/1991 | Godyak | 315/49 |
| 5,006,752 | 4/1991 | Eggink et al. | 313/161 |
| 5,006,763 | 4/1991 | Anderson | 315/248 |
| 5,013,975 | 5/1991 | Ukegawa et al. | 315/248 |
| 5,013,976 | 5/1991 | Butler | 315/248 |
| 5,239,238 | 8/1993 | Begervoet et al. | 315/248 |

RADIO FREQUENCY INTERFERENCE REDUCTION ARRANGEMENTS FOR ELECTRODELESS DISCHARGE LAMPS

CROSS-REFERENCE TO RELATED APPLICATIONS

This application is related to, and incorporates by reference, the following U.S. patent applications filed on the same date and assigned to the same assignee as the present application: the application entitled "Electrodeless Discharge Lamp with Spectral Reflector and High Pass Filter" filed by Nicholas G. Vrionis, application Ser. No. 07/887,165; the application entitled "Phosphor Protection Device for Electrodeless Discharge Lamp" filed by Nicholas G. Vrionis and John F. Waymouth, application Ser. No. 07/883,972; the application entitled "Base Mechanism to Attach an Electrodeless Discharge Light Bulb to a Socket in a Standard Lamp Harp Structure" filed by James W. Pfeiffer and Kenneth L. Blanchard, application Ser. No. 08/068,846; the application entitled "Discharge Light Bulbs and Lamps and Methods for Making Discharge Light Bulbs and Lamps", filed by Nicholas G. Vrionis, application Ser. No. 07/883,971; the application entitled "Stable Power Supply in an Electrically Isolated System Providing a High Power Factor and Low Harmonic Distortion" filed by Roger Siao, application Ser. No. 07/886,718; the application entitled "Zero-Voltage Complementary Switching High Efficiency Class D Amplifier" filed by Roger Siao, application Ser. No. 07/887,168; and the application entitled "Impedance Matching and Filter Network for Use With Electrodeless Discharge Lamp" filed by Roger Siao, application Ser. No. 07/887,166.

FIELD OF THE INVENTION

This invention relates to the reduction of radio frequency electromagnetic radiation emitted by an electrodeless discharge lamp. More specifically, the present invention relates to an electrically conductive screen and/or shield for substantially reducing radio frequency electromagnetic radiation emitted by the discharge vessel and the electronic circuitry of an electrodeless discharge lamp to comply with standards imposed with respect to the maximum admissible level of interference with wireless communication equipment such as radios and televisions.

BACKGROUND OF THE INVENTION

Electrodeless discharge lamps have many advantages over the conventional incandescent lamps, including higher efficiency, lower power consumption and longer life. Even though the discharge lamps cost more to manufacture initially, the extra initial cost is more than offset by the above advantages, resulting in a lower overall operating cost over time.

Although traditional fluorescent discharge lamps utilizing electrodes are now in common use and do have similar advantages to the electrodeless lamps, they cannot be manufactured in the same compact package. As a result, they cannot replace incandescent lamps where a fairly compact efficient unit is required. Alternatively, tungsten halogen lamps are available in compact units and are also more efficient than conventional incandescent lamps. However, they are less efficient than discharge lamps, may emit unwanted ultraviolet radiation, operate at higher temperatures and are also more vulnerable to mechanical shock.

Typically, electrodeless discharge lamps have a discharge vessel which is sealed in a gas tight manner and filled with a gaseous mixture comprising a metal vapor and a rare gas. An alternating current is fed through an induction coil in close proximity with the discharge vessel, generating an electromagnetic field within the discharge vessel. This electromagnetic field excites the gaseous mixture inside the discharge vessel, producing electromagnetic radiation by cycling between energy states. The electromagnetic radiation is then converted into visible light by a fluorescent layer on a surface of the discharge vessel.

However, a serious side effect of feeding an alternating current into an induction coil is the production of electromagnetic radiation which is transmitted into regions beyond the discharge vessel. In addition, the high frequency electronic circuitry also adds to the production of unwanted electromagnetic radiation. Unfortunately, some of the frequencies that can be generated by these electrodeless lamps fall within the wide band of radio frequencies reserved by the FCC for wireless communication equipment. For example, although the FCC has allocated 13.56 MHz for ISM (industrial, scientific and medical) uses, including the lamps, the fifth harmonic of 13.56 MHz falls within the range 64–71 MHz reserved for television broadcast of Channel 4. As a result, these discharge lamps can interfere with the operation of wireless communication equipment unless measures are taken to reduce the intensity of the electromagnetic radiation.

Various methods of reducing this unwanted radio frequency radiation have been proposed but they all have significant disadvantages. One method involves the vapor deposition of a transparent layer of electrically conductive material, typically tin oxide, on the inner surface of the discharge vessel. This layer is then grounded to the power supply. Such a method is disclosed in U.S. Pat. No. 4,728,867, where a fluorine-doped layer of transparent tin oxide is deposited onto the inner surface of the discharge vessel. This layer is then grounded by means of a metal spring.

Several variations of this evaporated transparent tin oxide layer have also been suggested. Some disclose use of the transparent conductive layer over selected areas of the inner surface of the discharge vessel. Others disclose the inner transparent conductive layer in combination with other forms of shielding.

U.S. Pat. No. 4,940,923 discloses the initial vapor deposition of a wide horizontal strip of transparent, electrically conductive aluminum (thickness approximately 2 microns) onto the inner surface of the discharge vessel. From this aluminum strip, three rings are formed by removing parts of the strip using a laser beam from the outside. This layer is then grounded by a wire connected to the inner conductive layer by penetrating the wall of the discharge vessel.

Yet another variation of an inner transparent conductive layer is disclosed in U.S. Pat. Nos. 4,568,859 and 4,645,967, where a transparent conductive layer of tin doped indium oxide is deposited on the inner surface of the discharge vessel. In addition, three copper rings are disposed around the outside surface of the discharge vessel at the level of the induction coil in grooves provided for this purpose.

However all the above-described methods which disclose the vapor deposition of a transparent conductive layer on the inner surface of the discharge vessel suffer from several serious problems. First, the conductive layer, being disposed within the discharge vessel, is exposed to the hostile metal vapor environment. Second, some means of conduction must be provided to ground the inner conductive layer to the exterior of the discharge vessel. Third, any conductive layer or strip that provides an unbroken circular electrical path may behave like a "shorted turn" to the induction coil and further reduces the efficiency of the discharge lamp. Fourth, this inner layer vapor deposition process must also be well controlled so as to deposit just the right thickness of the conductive material to satisfy the trade off between electrical conductivity and light transmission.

Other, non-shielding methods have also been suggested. Examples include U.S. Pat. No. 4,171,503 which discloses an induction coil wound in the form of a toroidal helix to minimize the microwave radiation leaks. Such a shaped coil is employed to minimize microwave radiation associated with cylindrical induction coils. However, toroidal helix shapes are costly to manufacture.

U.S. Pat. No. 4,254,363 discloses several windings comprising transparent tin oxide stripes deposited over selected portions of the discharge vessel. However these windings carry current and function as the source of the magnetic field rather then as an electromagnetic radiation shield.

SUMMARY OF THE INVENTION

Accordingly, it is an object of the present invention to provide a cost effective, electrically conductive screen and/or shield for shielding the electromagnetic radiation emitted by an electrodeless discharge lamp. The screen should have good shielding characteristics while minimizing the formation of "shorted turns". In addition, the part of the conductive screen that envelopes the discharge vessel should not significantly impede the transmission of visible light and should preferably be at least 95% efficient in light transmission.

It is another object of the present invention to provide a conductive screen that is not exposed to the hostile metal vapor and is easy to manufacture.

It is yet another object of the present invention to provide a conductive shield that substantially reduces the electromagnetic radiation from the electronic circuitry of the electrodeless lamp.

In accordance with this invention, an electrically conductive screen and/or shield is provided, disposed outside the space occupied by the gaseous mixture. The screen can be grounded via the power supply. Radio frequency electromagnetic radiation emitted by the induction coil beyond the discharge vessel is substantially shielded by this conductive screen. An electrically conductive shield can also be provided, at least partially enclosing the electronic circuitry of the electrodeless lamp. As a result, the level of radiation beyond the lamp is significantly reduced, This reduction in radiation level is necessary to comply with standards imposed with respect to the maximum admissible level of interference with wireless receivers such as radios and televisions.

In a first embodiment, a screen comprising a layer of transparent or semi-transparent electrically conductive material is deposited on selected portions of the outside surface of the discharge vessel. The screen is grounded by means of a curved conductive band disposed along the base of the discharge vessel.

In a second embodiment, an outer envelope, made of a transparent or semi-transparent material such as glass, substantially encloses the discharge vessel. An electrically conductive screen comprising a layer of transparent or semi-transparent material is deposited on selected portions of the outside surface of the outer envelope. This screen is grounded by means of a curved conductive band disposed along the base of the outer envelope.

In a third embodiment, an outer envelope similar to that of the second embodiment is provided. An electrically conductive screen comprising a light-permeable material is disposed between the discharge vessel and the outer envelope. This light-permeable screen can be made of a variety of suitable materials, such as a woven mesh of fine metal strands or a thin sheet of expanded metal having a plurality of perforations. This screen is also grounded.

In a fourth embodiment, the discharge vessel has a cavity into which the induction coil fits. This cavity is substantially enclosed by a wall. A gaseous mixture is contained within the space between the outside surface of the wall of the cavity and the inner surface of the discharge vessel. A screen comprising a layer of electrically conductive material is deposited on selected portions of the inside surface of the wall of the cavity. The conductive screen is grounded by means of a curved conductive band disposed along the base of the cavity.

In a fifth embodiment, which can be used in conjunction with any of the above embodiments, an electrically conductive shield is provided which at least partially encloses the electronic circuitry of the electrodeless lamp, typically located at the base of the discharge vessel. This shield is not grounded, i.e. it "floats" electrically.

Further objects and advantages of the subject invention will become apparent from the following detailed description when taken in conjunction with the drawings.

DETAILED DESCRIPTION OF THE PREFERRED EMBODIMENTS

Figure 1A:
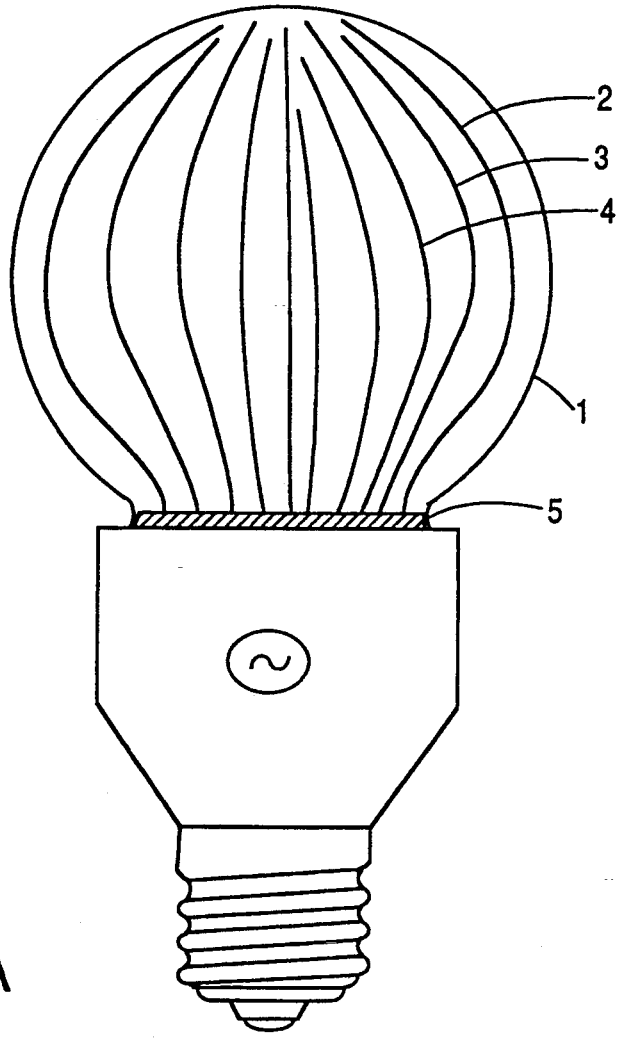
FIG. 1A is a front view of a first embodiment of the discharge lamp including a conductive screen according to the present invention.
Figure 1B:
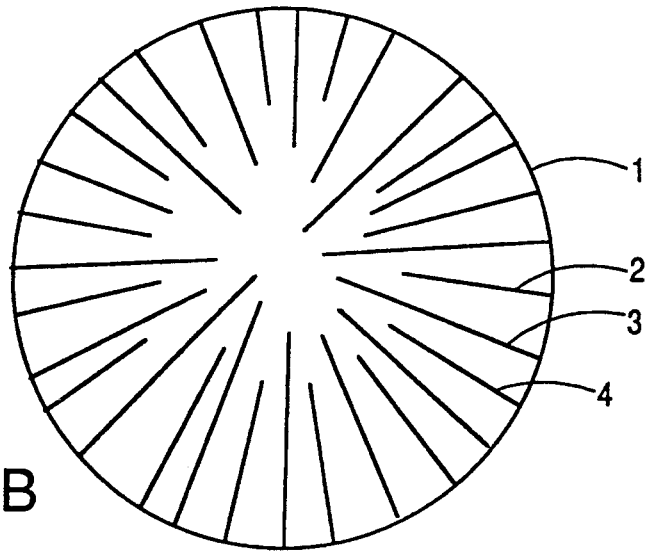
FIG. 1B is a top view of a first embodiment of the discharge lamp including a conductive screen.

Referring now to FIG. 1A, a first embodiment of the discharge lamp including a discharge vessel 1. An outer conductive screen comprising a plurality of transparent or semi-transparent fingers is shown, as illustrated by three of these fingers 2, 3, and 4. These fingers are made by the vapor deposition of a thin layer of electrically conductive material, such as tin oxide, indium tin oxide, aluminum or copper, onto the outer surface of the discharge vessel 1, using the photo-mask technique well known in the semiconductor fabrication arts. Alternatively, the fingers can be made by evaporation of a metal through a patterned mask. These fingers are vertically disposed and fairly evenly distributed around the outside surface of the discharge vessel 1. The thickness of the fingers should preferably be in the sub-micron range, and about ⅛ to 1/16 of an inch wide, maintaining a practical tradeoff between electrical conductivity and light transmission. These conductive fingers are grounded via a curved electrically conductive band 5 located at the base of the discharge vessel and this band 5 can either be made of the same material as the fingers or any other suitable conductive material. Band 5 should also have a non-conducting gap, so as not to form a "shorted turn". FIG. 1B is a top view of the first embodiment and shows the top portion of the discharge vessel 1 where the conductive fingers point towards each other but do not make electrical contact, to avoid forming "shorted turns".

Figure 2A:
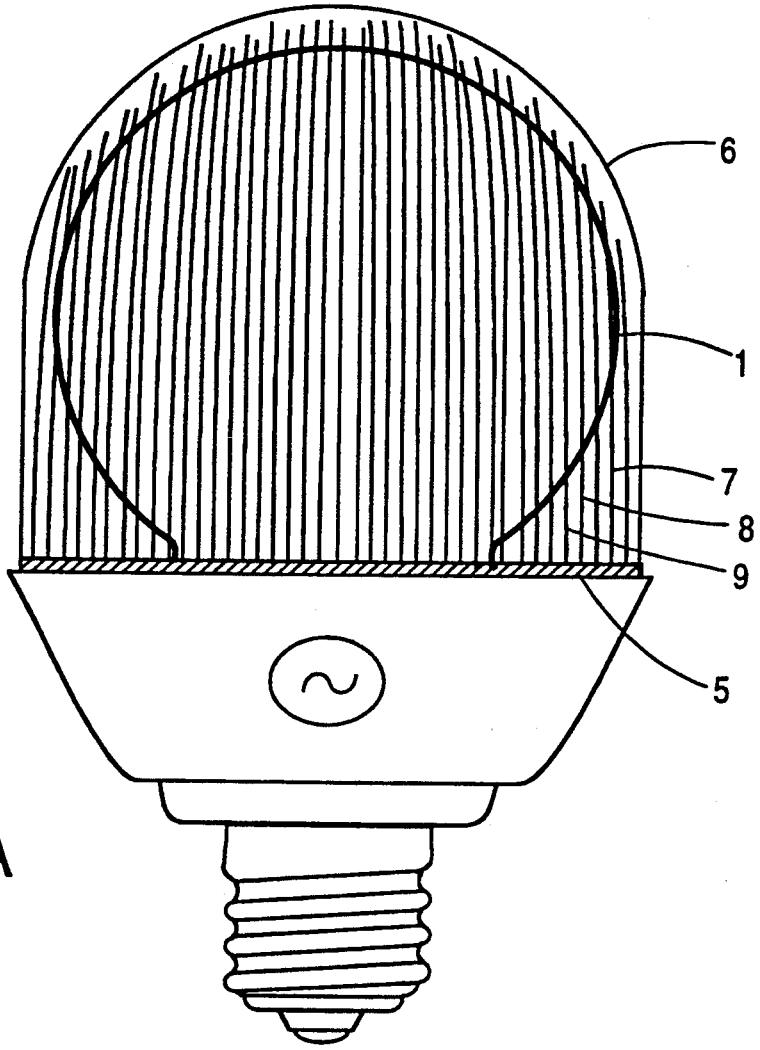
FIG. 2A is a front view of a second embodiment of the discharge lamp including a conductive screen.
Figure 2B:
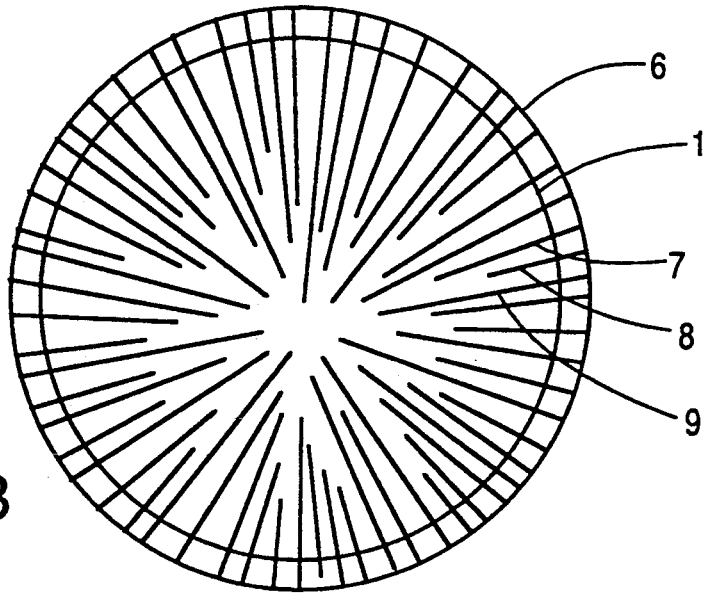
FIG. 2B is a top view of a second embodiment of the discharge lamp including a conductive screen.

Referring now to FIG. 2A, a second embodiment of the discharge lamp having an outer envelope 6 substantially enclosing the discharge vessel 1 and made of a transparent or semi-transparent material such as glass, is shown. A screen is disposed outside the outer envelope 6 and comprises a plurality of transparent or semi-transparent fingers, as illustrated by three of these fingers 7, 8 and 9. These fingers are made by the vapor deposition of a thin layer of electrically conductive material, such as tin oxide, indium tin oxide, aluminum or copper, onto the outer surface of the outer envelope 6 using the photo-mask vapor deposition technique. Alternatively, the fingers can be made by evaporation of a metal through a patterned mask. These fingers are vertically disposed and fairly evenly distributed over the inside or outside surface of the outer envelope 6. The thickness of the fingers should preferably in the sub-micron range, and about ⅛ to 1/16 of an inch wide, maintaining a practical tradeoff between electrical conductivity and light transmission. These fingers are grounded via a curved electrically conductive band 5 located at the base of the outer transparent envelope and the band 5 can either be made of the same material as the fingers or any other conductive material. This band 5 may have a non-conducting gap, so as to avoid the possible formation of a "shorted turn". FIG. 2B is a top view of the second embodiment and shows the top portion of the outer envelope 6 where the conductive fingers point towards each other but are not in electrical contact to avoid forming "shorted turns".

Figure 3:
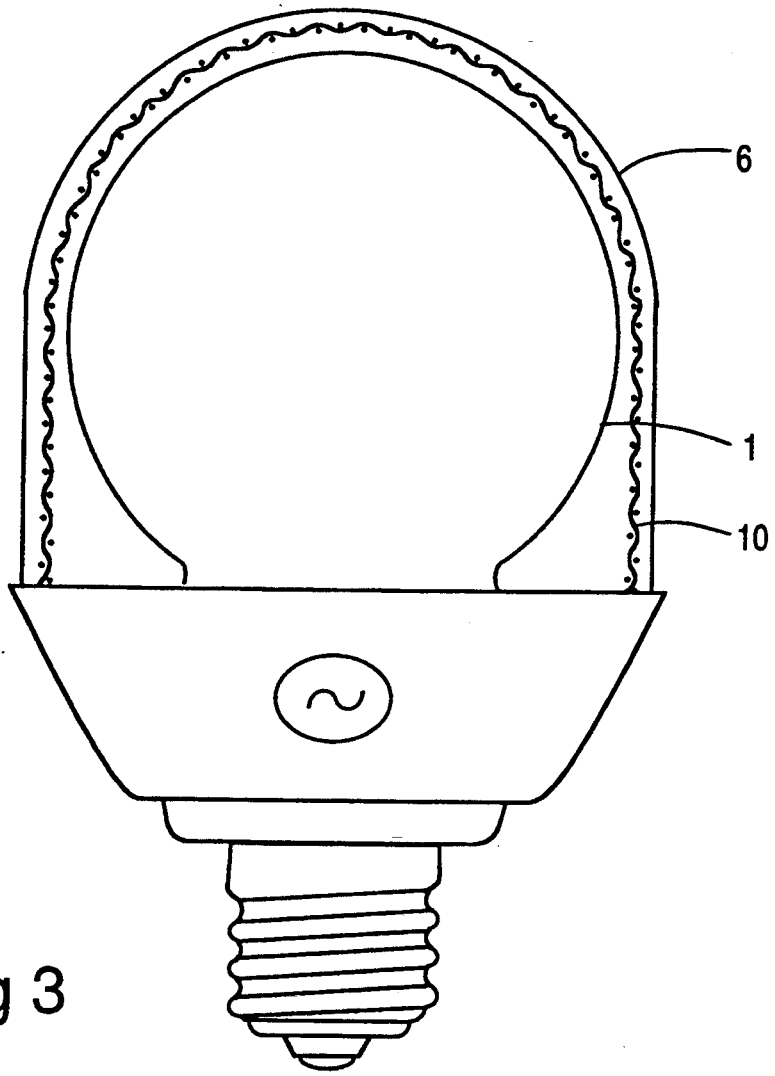
FIG. 3 is the front view of a third embodiment of the discharge lamp including a conductive screen.
Figure 5A:
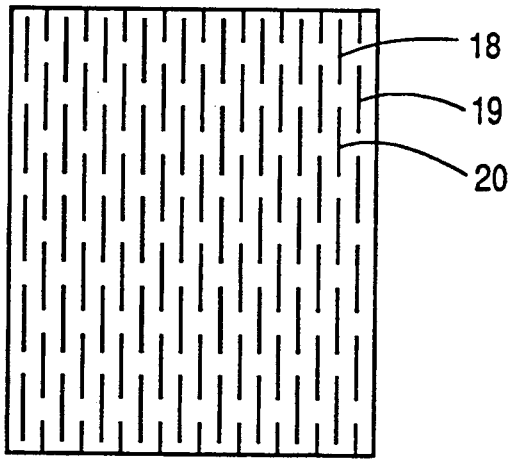
FIG. 5A is a front view of a sheet of electrically conductive metal with a plurality of slits, before it is expanded.
Figure 5B:
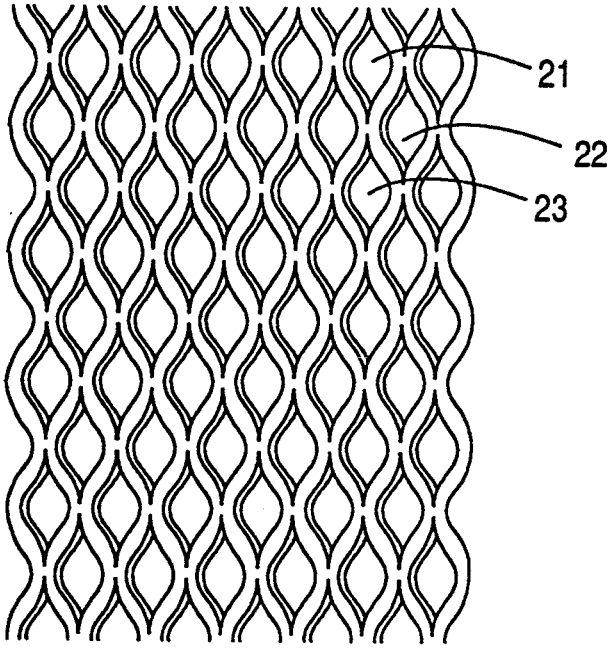
FIG. 5B is a front view of a sheet of expanded metal, after the sheet has been expanded.

Referring now to FIG. 3, a third embodiment of the discharge lamp which has a transparent outer envelope 6 similar to that of the second embodiment is shown. A conductive screen 10 comprises of a light-permeable material disposed in the space between discharge vessel 1 and outer envelope 6, and substantially covering discharge vessel 1. Examples of an electrically conductive light-permeable material include a finely woven mesh of thin metal strands, or a thin sheet of expanded metal having a plurality of perforations. One such embodiment of the expanded metal is formed by making a series of slits on a thin sheet of conductive metal as illustrated by three of these slits 18, 19 and 20 in FIG. 5A. The sheet is then stretched to form the perforations of the expanded metal as illustrated by three of these perforations 21, 22 and 23 in FIG. 5B. The light-permeable material should preferably be at least 95% efficient in light transmission. The conductive screen 10 is also grounded. In order to minimize the possible formation of "shorted turns", the conductive screen 10 may have at least one vertical non-conductive gap extending from the top of the discharge vessel to the bottom of the discharge vessel.

In the three above-described embodiments of the discharge lamp, radio frequency electromagnetic radiation emitted beyond the discharge vessel by the induction coil is substantially reduced by the conductive screen which substantially encloses the discharge vessel. As a result, this radiation may be reduced, in particular, to levels that are in compliance with standards imposed with respect to the maximum permissible level of interference with wireless receivers such as radios and televisions.

Figure 4:
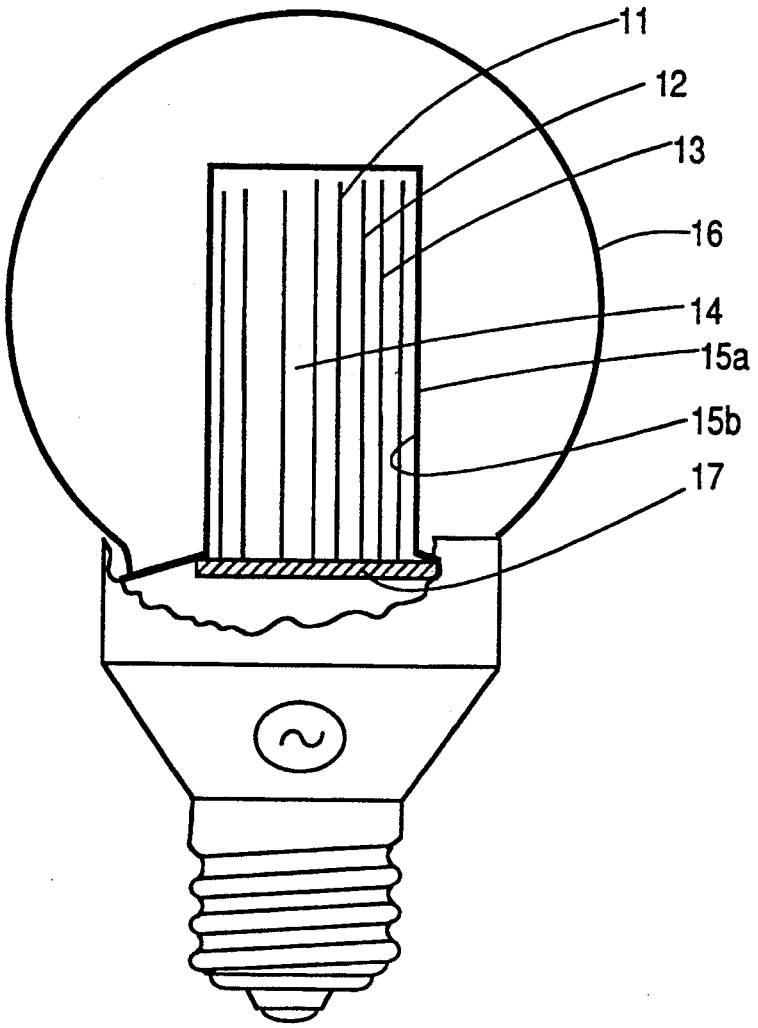
FIG. 4 is a front view of a fourth embodiment of the discharge lamp including a conductive screen.

Referring now to FIG. 4, a fourth embodiment of the discharge lamp in which a discharge vessel 16 has an central cavity 14. The cavity 14 is substantially enclosed by a wall which has an outside surface 15*a* and an inside surface 15*b*. The induction coil (not shown) is located substantially within cavity 14. The gaseous mixture is contained within the space between the outside surface 15*a* of the cavity wall and the inner surface of the discharge vessel 16. The conductive screen comprising a plurality of fingers is shown, as illustrated by three of these fingers 11, 12 and 13. These fingers are made by vapor deposition of a thin layer of conductive material, such as tin oxide, indium tin oxide, aluminum or copper, onto the inside surface 15*b* of wall of the cavity, using the photo-mask technique. Alternatively, the fingers can be made by evaporation of a metal through a patterned mask. The fingers are vertically disposed and evenly distributed around the inside surface 15*a* of the cavity wall. The thickness of the fingers should preferably in the sub-micron range and about ⅛ to 1/16 of an inch wide. These conductive fingers are grounded via a curved conductive band 17 located at the base of cavity 14 and the band 17 can either be made of the same material as the fingers or any other conductive material. This band 17 may have a non-conducting gap, so as to avoid the possible formation of a "shorted turn". Similarly, the conductive fingers are also electrically disconnected at the top of the cavity 14 to avoid forming "shorted turns". In one variation of the fourth embodiment of the discharge lamp, the conductive fingers are solid metal fingers. In another variation of the fourth embodiment, these fingers are replaced by the woven metal mesh or expanded metal provided in the third embodiment.

Figure 1C:
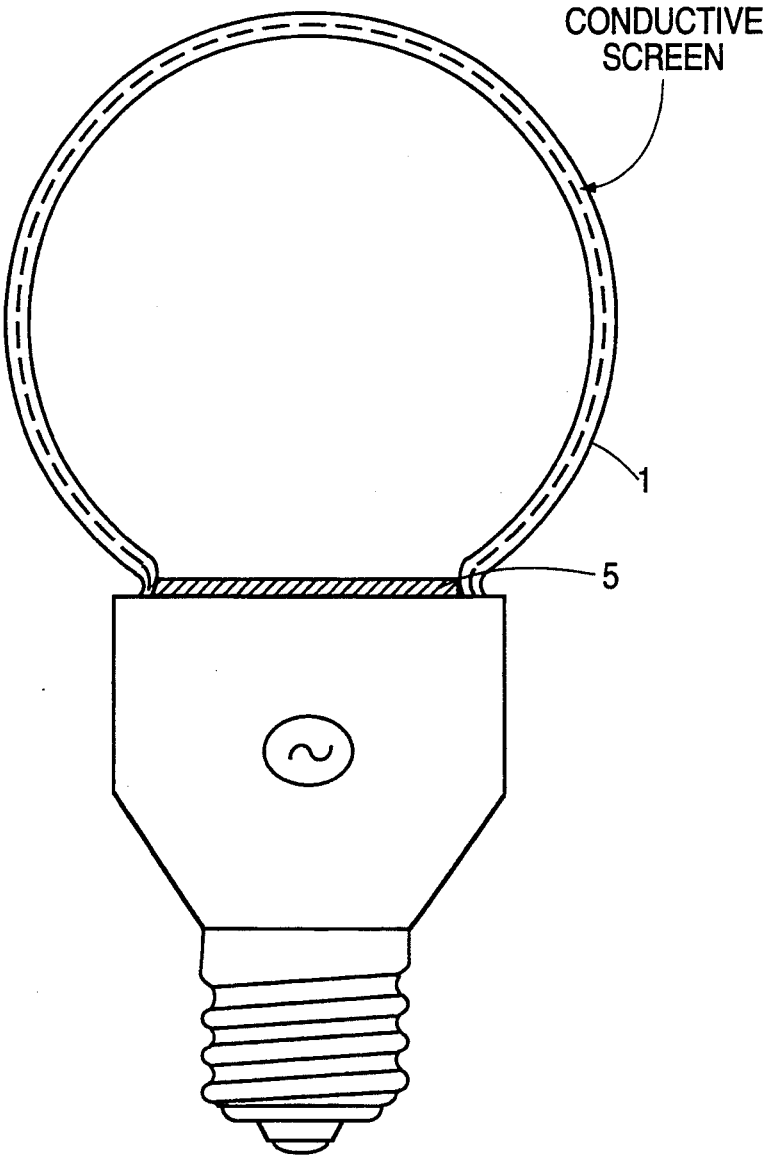
FIG. 1C is a front view of an embodiment in which the conductive screen is embedded in the discharge vessel.
Figure 2C:
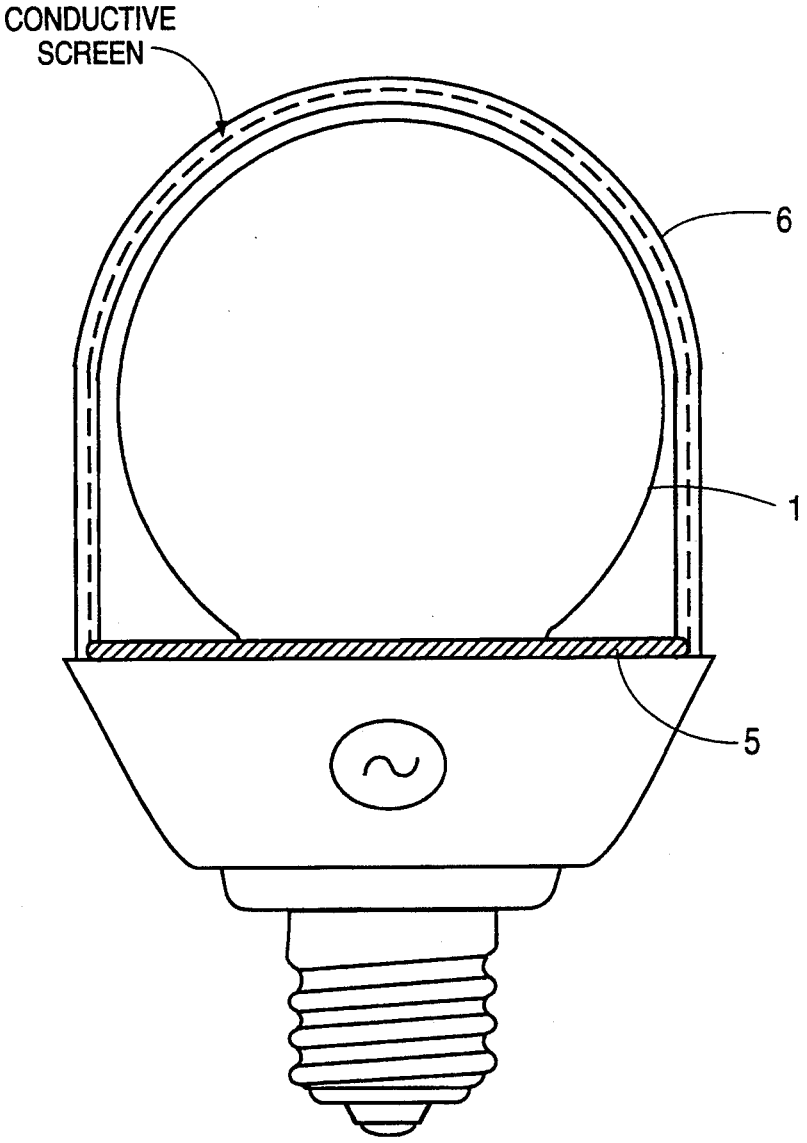
FIG. 2C is a front view of an embodiment in which the conductive screen is embedded in the outer envelope.

In yet another embodiment, as shown in FIG. 1C, an electrically conductive screen is embedded within the transparent or translucent material that forms the discharge vessel of the first embodiment. Alternatively, as shown in FIG. 2C, the screen is embedded within the outer envelope of the second embodiment. This conductive screen can be a plurality of substantially vertical fingers comprising metallic wires which are grounded at the base.

Figure 6:
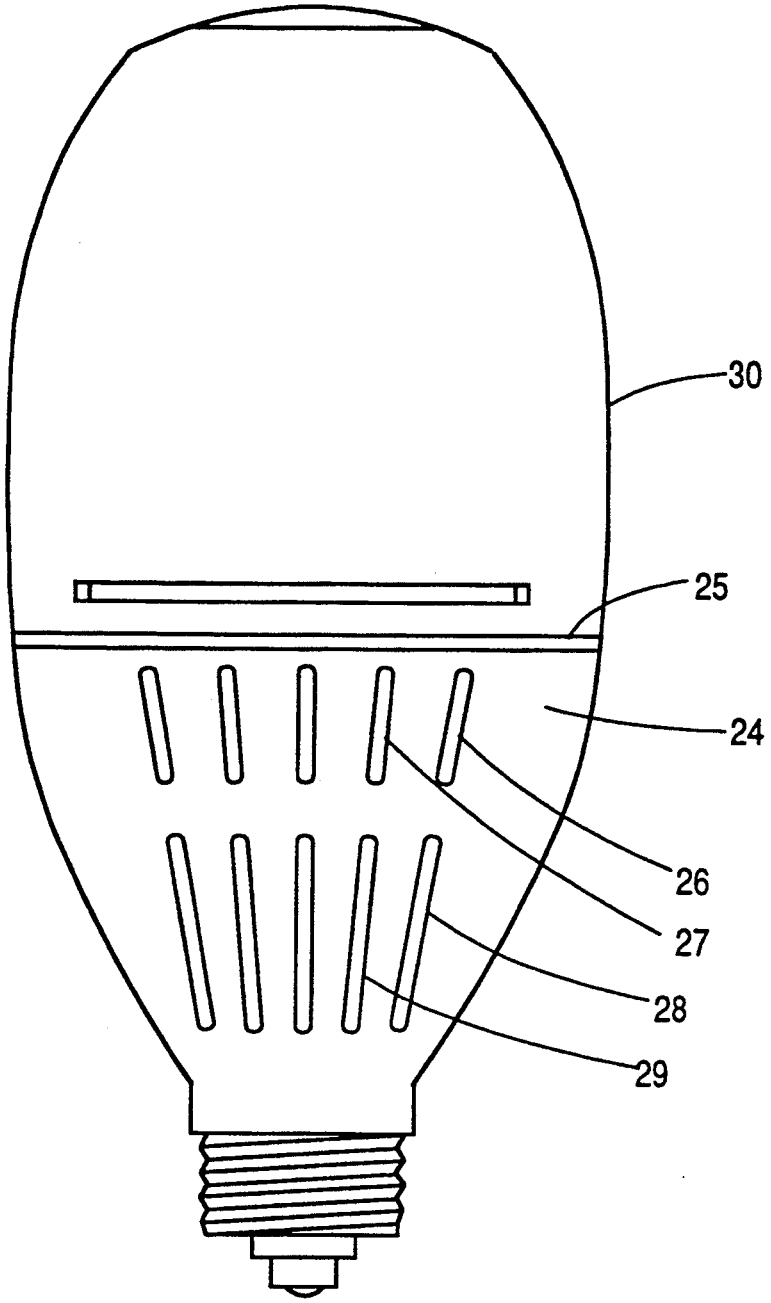
FIG. 6 is a front view of a fifth embodiment of the discharge lamp including a shield for the electronic circuitry.

Referring now to FIG. 6, in a fifth embodiment, which can be used alone or in combination with any of the above embodiments, an electrically conductive shield 24 is provided which at least partially encloses the electronic circuitry of the electrodeless lamp. This electronic circuitry is typically located at the base of the discharge vessel 30. In this embodiment, a top 25 of shield 24 is attached to the base of the discharge vessel and is not grounded, i.e. it "floats" electrically. Shield 24 is made of an electrically conductive material, typically a metal, which is normally also a good heat conductor, thereby also providing a thermal conduction path for dissipating heat generated by the circuitry. Perforations such as slots 26, 27, 28 and 29 or slits, or protrusions such as fins, or combinations thereof, are also distributed around the shield to provide another heat dissipation path via improved air circulation. In addition, these perforations and protrusions are shaped and located in such a way that passage of radiation through them is minimized.

Although the invention has been described in terms of specific embodiments for illustrative purposes, it will be appreciated by one skilled in the art that numerous additions, subtractions, and modifications are possible without departing from the scope and spirit of the invention as defined in the claims. For example, although this invention has been described in conjunction with discharge lamps having a coating of phosphors on the surface of the gas light vessel, the principles of this invention also apply to other types of electrodeless discharge lamps including those wherein visible light is generated directly by the enclosed gas.

We claim:

1. An electrodeless discharge lamp comprising:

a discharge vessel sealed in a gas tight manner, said discharge vessel having an inner surface and an outer surface;

a gaseous mixture disposed within said discharge vessel;

means for generating an electromagnetic field for exciting said gaseous mixture, said excited gaseous mixture producing electromagnetic radiation, said means for generating comprising electronic components; and a shielding member, said shielding member comprising an electrically conductive shield at least partially enclosing said electronic components and an electrically conductive screen at least partially enclosing said discharge vessel, said shield and said screen being electrically joined together near a base of said discharge vessel.

2. An electrodeless discharge lamp comprising:

a discharge vessel sealed in a gas tight manner, said discharge vessel having an inner surface and an outer surface;

a gaseous mixture disposed within said discharge vessel;

means for generating an electromagnetic field for exciting said gaseous mixture, said excited gaseous mixture producing electromagnetic radiation; and an electrically conductive screen disposed outside of said discharge vessel, wherein said conductive screen comprises a plurality of electrically conductive fingers.

3. An electrodeless discharge lamp as claimed in claim 2, wherein said conductive fingers are substantially vertically disposed on the outer surface of said discharge vessel.

4. An electrodeless discharge lamp as claimed in claim 3, wherein said conductive fingers are electrically disconnected at a first end of said discharge vessel, and said conductive fingers are electrically connected at a second end of said discharge vessel.

5. An electrodeless discharge lamp comprising:

a discharge vessel sealed in a gas tight manner, said discharge vessel having an inner surface and an outer surface;

a gaseous mixture disposed within said discharge vessel;

means for generating an electromagnetic field for exciting said gaseous mixture, said excited gaseous mixture producing electromagnetic radiation;

an electrically conductive screen disposed outside of said discharge vessel; and an outer lamp envelope spaced away from said discharge vessel and substantially enclosing said discharge vessel, said lamp envelope having an inner surface and an outer surface.

6. An electrodeless discharge lamp as claimed in claim 5, wherein said conductive screen is disposed outside of said outer lamp envelope.

7. An electrodeless discharge lamp as claimed in claim 6, wherein said conductive screen comprises of a plurality of electrically conductive fingers.

8. An electrodeless discharge lamp as claimed in claim 7, wherein said conductive fingers are substantially vertically disposed on the outer surface of said lamp envelope.

9. An electrodeless discharge lamp as claimed in claim 8, wherein said conductive fingers are electrically disconnected at a first end of said lamp envelope, and said conductive fingers are electrically connected at a second end of said lamp envelope.

10. An electrodeless discharge lamp as claimed in claim 5, wherein said conductive screen is disposed between the outer surface of said discharge vessel and the inner surface of said outer lamp envelope.

11. An electrodeless discharge lamp as claimed in claim 10, wherein said conductive screen comprises a plurality of electrically conductive strands.

12. An electrodeless discharge lamp as claimed in claim 11, wherein said conductive strands form a woven mesh.

13. An electrodeless discharge lamp as claimed in claim 10, wherein said conductive screen comprises a sheet of expanded metal having a plurality of perforations.

14. An electrodeless discharge lamp as claimed in claim 13, wherein said perforations are formed from a plurality of slits.

15. An electrodeless discharge lamp comprising:

a discharge vessel sealed in a gas tight manner, said discharge vessel having an inner surface and an outer surface, and being configured so as to form a cavity;

a wall substantially enclosing said cavity, said wall having an inside surface and an outside surface;

a gaseous mixture disposed within said discharge vessel;

means for generating an electromagnetic field for exciting said gaseous mixture, said means for generating substantially disposed within said cavity, and said excited gaseous mixture producing electromagnetic radiation; and an electrically conductive screen substantially disposed inside said cavity.

16. An electrodeless discharge lamp as claimed in claim 15, wherein said conductive screen comprises a plurality of electrically conductive fingers.

17. An electrodeless discharge lamp as claimed in claim 16, wherein said conductive fingers are substantially vertically disposed on the inside surface of said cavity.

18. An electrodeless discharge lamp as claimed in claim 17, wherein said conductive fingers are electrically disconnected at a first end of said cavity, and said conductive fingers are electrically connected at a second end of cavity.

19. An electrodeless discharge lamp as claimed in claim 15, wherein said conductive screen comprises a plurality of electrically conductive strands.

20. An electrodeless discharge lamp as claimed in claim 19, wherein said conductive strands form a woven mesh.

21. An electrodeless discharge lamp as claimed in claim 15, wherein said conductive screen comprises a sheet of expanded metal having a plurality of perforations.

22. An electrodeless discharge lamp as claimed in claim 21, wherein said perforations are formed from a plurality of slits.

23. An electrodeless discharge lamp comprising:

a discharge vessel sealed in a gas tight manner, said discharge vessel having an inner surface and an outer surface;

a gaseous mixture disposed within said discharge vessel;

means for generating an electromagnetic field for exciting said gaseous mixture, said excited gaseous mixture producing electromagnetic radiation, said means for generating comprising electronic components; and a shielding member, said shielding member comprising an electrically conductive shield at least partially enclosing said electronic components and an electrically conductive screen disposed between the inner and the outer surface of said discharge vessel, said shield and said screen being electrically joined together near a base of said discharge vessel.

24. An electrodeless discharge lamp as claimed in claim 23, wherein said discharge vessel further comprises a wall, and said conductive screen is substantially embedded within said wall.

25. An electrodeless discharge lamp as claimed in claim 5, wherein said conductive screen is disposed between the inner and the outer surface of said outer lamp envelope.

26. An electrodeless discharge lamp as claimed in claim 25, wherein said outer envelope further comprises a wall, and said conductive screen is substantially embedded within said wall.

27. Method of reducing electromagnetic radiation from an electrodeless discharge lamp, said lamp comprising a discharge vessel sealed in a gas tight manner, said discharge vessel having an inner surface and an outer surface, a gaseous mixture disposed within said discharge vessel, means for generating an electromagnetic field for exciting said gaseous mixture, said means comprising electronic components, said excited gaseous mixture producing electromagnetic radiation, said method comprising substantially enclosing said lamp with a shielding member, said shielding member comprising an electrically conductive shield at least partially enclosing said electronic components and an electrically conductive screen at least partially enclosing said discharge vessel, said shield and said screen being electrically joined together near a base of said discharge vessel.

28. An electrodeless discharge lamp comprising:

a discharge vessel sealed in a gas tight manner, said discharge vessel having an inner surface and an outer surface;

a gaseous mixture disposed within said discharge vessel;

means for generating an electromagnetic field for exciting said gaseous mixture, said excited gaseous mixture producing electromagnetic radiation; and an electrically conductive shield at least partially enclosing said generating means, wherein said conductive shield has a plurality of perforations.

29. An electrodeless discharge lamp as claimed in claim 28, wherein said perforations are slots or slits.

30. An electrodeless discharge comprising:

a discharge vessel sealed in a gas tight manner, said discharge vessel having an inner surface and an outer surface;

a gaseous mixture disposed within said discharge vessel;

means for generating an electromagnetic field for exciting said gaseous mixture, said excited gaseous mixture producing electromagnetic radiation; and an electrically conductive shield at least partially enclosing said generating means, wherein said conductive shield has a plurality of protrusions.

31. An electrodeless discharge lamp as claimed in claim 30, wherein said protrusions are fins.

* * * * *